US006135602A

United States Patent [19]

Chuang

[11] Patent Number: 6,135,602

[45] Date of Patent: Oct. 24, 2000

[54] PROFILES OF SHADOWLESS REFLECTOR FOR OPERATING LIGHTING

[75] Inventor: Yung-Fu Chuang, Taipei, Taiwan

[73] Assignee: Medline Enterprise Co., Ltd., Taipei, Taiwan

[21] Appl. No.: 09/235,299

[22] Filed: Jan. 22, 1999

[51] Int. Cl.[7] ..... F21V 13/08

[52] U.S. Cl. ..... 362/33; 362/348; 362/804

[58] Field of Search ..... 362/33, 293, 294, 362/297, 304, 346, 348, 804

[56] References Cited

U.S. PATENT DOCUMENTS

| | | | |
|---|---|---|---|
| 2,215,634 | 9/1940 | Collins et al. | 362/33 |
| 5,331,530 | 7/1994 | Scholz | 362/293 |
| 5,971,569 | 10/1999 | Smith et al. | 362/304 |

*Primary Examiner*—Y. Quach
*Attorney, Agent, or Firm*—Bacon & Thomas, PLLC

[57] ABSTRACT

Profiles for shadowless reflector for operating lighting, wherein the operating lighting includes a front and a rear shade assembled together while the front shade has an opening for projecting the light rays, and the rear shade is mounted over the opening; the lower edge of the reflector's opening in the front and the rear shades is fixed on the front transparent shade which has a handle at the edge thereof while a socket for bulbs is installed over the front transparent shade; the bulb is enclosed by a heat absorbing glass; the light rays received by the reflector are focused on the front transparent shade and are projected; the longitudinal tangent of the reflector in the longitudinal direction consists of at least two connecting datum curves, and the connecting datum curves has the same tangent slope rate at the connecting point; each datum curve reflects the light rays well-distributed to the focusing datum plane; The datum curve of the reflector near the end point of the middle of the reflector reflects the light rays onto the circumference of the focusing circle diameter the same side to the end point, and the last datum curve nearer to the end point of the outer edge of the reflector reflects the light rays onto the circumference of the corresponding focusing circle the same side thereto.

3 Claims, 6 Drawing Sheets

PROFILES OF SHADOWLESS REFLECTOR FOR OPERATING LIGHTING

BACKGROUND OF THE INVENTION

1. Field of the Invention

The present invention relates to the profile of a shadowless reflector for surgical lighting, and especially to a reflector's profile which can reflect the light rays produced from a single bulb all around an object and thereby eliminate shadows.

2. Description of the Prior Art

For the conventional operating lighting use to illuminate a patient during operations, it is hard to prevent the head shadow and hand shadow of surgeons from projecting onto the patient. The conventional surgical lighting is quite easy to influence a surgeon's sight. Therefore, the conventional operating lighting is required to be improved. The most common solution thereto is to arrange the light fixture with many mini-reflectors and bulbs, which are utilized to project cylindrical light rays. The projected cylindrical light rays have the same diameter and are focused on the same plane. However, the focusing datum plane and the light head distance must be adjusted when the distance of the light head and the operated position is changed. For this kind of light head, the individual adjustment of bulbs is very inconvenient in practice. In addition, compared with the conventional operating lighting, the structure of a light head of with mini-reflectors and bulbs is more complicated, the cost is higher, the weight is increased and the mobility is not good as well.

Consequently, a light fixture with one light source and a single large reflector is able to resolve the above problem of a plurality of mini-reflectors and bulbs. FIG. 1 shows the basic structure and the light path of the most common used conventional light head with single large reflector. The reflector 1 reflects the light rays scattered from the bulb 2 to a planed focusing datum plane and the light rays form a cylindrical illuminating range 4 so that each area in this illuminating range is illuminated by light rays projecting in only two-directions. Generally, partial light rays 5 are blocked at the place under the head position 9 of the surgeon position and near the lower position of the operating room light fixture. Due to the shadow caused by hands and instruments, it is therefore required to have a second or third light head to simultaneously project light rays on the same position to produce good shadowless effect.

It is also necessary that the light head with single large reflector should facilitate the movement of the position and the direction. Therefore, a handle 6 including a fixed disk-shaped portion 7 is mounted under the center of light head, which limits the illumination range of the light, sources. The lost diameter of the reflector $\phi$ Y, as shown in FIG. 1, must be larger than the diameter of the disk-shaped portion $\phi$ X because the lost angle of light source A is too large to make use of the light rays produced by the bulb, while the front-glass 8 of the operating light head also tends to reduce the brightness. In order to remove the filament figure and to enhance the well-distributed illumination in the illuminating range 4, the conventional light head with single large reflector makes use of a front glass 8 with wave lines to produce a softening effect. However, the penetrating rate of the visible light through the wave-shaped front glass 8 is approx. 50%, tremendously reducing the illumination in the illuminating range. Due to the effects described above, in addition to the disadvantage of bad shadowless effect, the waste of the light source results in the disadvantage that the brightness can't be further enhanced.

SUMMARY OF THE INVENTION

In order to enhance the shadowless effect and the illuminating brightness of the operating room light fixture, a new profile for a shadowless reflector for surgical lighting has been invented.

The main object of the present invention is to provide profiles of a shadowless reflector for operating lighting. The inner surface of the reflector is formed by at least two different datum curves turned 360° around the centerline of the reflector. The two datum curves are used to form several small planes which are tangent to the curves or intersected therewith, and include a front intersection with the longitudinal tangent plane. These small planes can be turned around the centerline of the reflector every certain angle to form another reflector. In addition to being away from the head position of the surgeon in operation, the light rays reflected by the first datum curve and the second datum curve evenly shine with different angles on the same area of the focusing datum plane so that the shadowless effect is also promoted. Moreover, the reflector can be equiangularly divided into a plurality of small planes in the longitudinal and latitudinal direction. By doing this a partial light scattering effect will be produced in the illuminating range to weaken the shadow of the hand and medical instruments, while maintaining the softening function of the conventional wave type front glass 8. Therefore, the wave type front glass 21 can be replaced with a place type front glass having a penetrating rate for visible light of over 95%, which considerably enhances the illumination in the illuminating range 30.

BRIEF DESCRIPTION OF THE DRAWINGS

The drawings disclose illustrative embodiments of the present invention, which serve to exemplify the various advantages and objects hereof, and are as follows.

DETAILED DESCRIPTION OF THE PREFERRED EMBODIMENT

Figure 2:
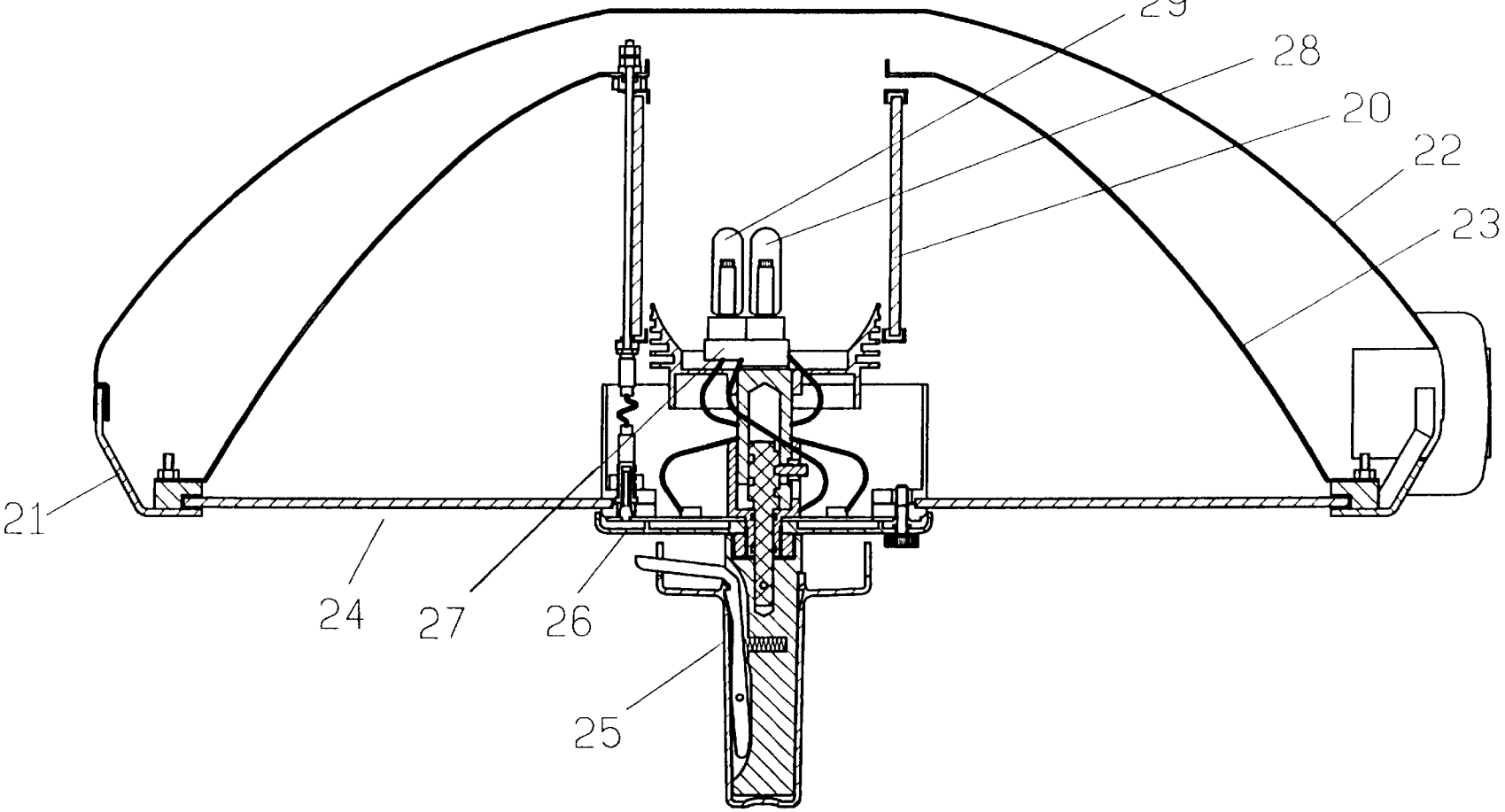
FIG. 2 is a basic assembly structure view of the light head of the present invention.

The present invention relates to profiles of shadowless reflectors for operating room lighting, especially applied to a surgical light fixture. The whole structure of the present invention is illustrated in FIG. 2, which includes a front lampshade 21 and a rear lampshade 22. Between front lampshade 21 and rear lampshade 22, a large round opening is mounted for the light to pass through. Over that opening lies a circular front glass 24 which dimension is larger than the opening. The opening lower edge of an inverted bowl-shaped reflector 23 is fixed at a small distance away from the top of the front glass 24 whose center is circular and hollow. A disk-shaped portion 26 of a handle 25 is installed under the opening edge of the center. A socket 27 is mounted in the middle of the top surface of the front glass 24 while the handle 25 is located in the opposite side thereof. A bulb 28 and a reserve bulb 29 are placed in the socket 27 and enclosed by a cylindrical heat absorbing glass 20. The enclosed volume of the light is from the top edge of the socket 27 to the top of the inner surface adjacent to the reflector 23. The light rays produced by the bulb 28 or the reserve bulb 29 must pass through the heat absorbing glass 20 to reach the reflector 23. The top of the reflector 23 has a circular opening almost equal to the inner diameter of the heat absorbing glass 20. The heat is easily radiated to the rear lampshade 22 made of aluminum alloy and the heat is scattered by the huge area outside the operating room light fixture. The light rays received by the reflector 23, passing through the front glass 24, are focused at a place one meter away from the front glass 24 and form a cylindrical illuminating range.

Figure 3:
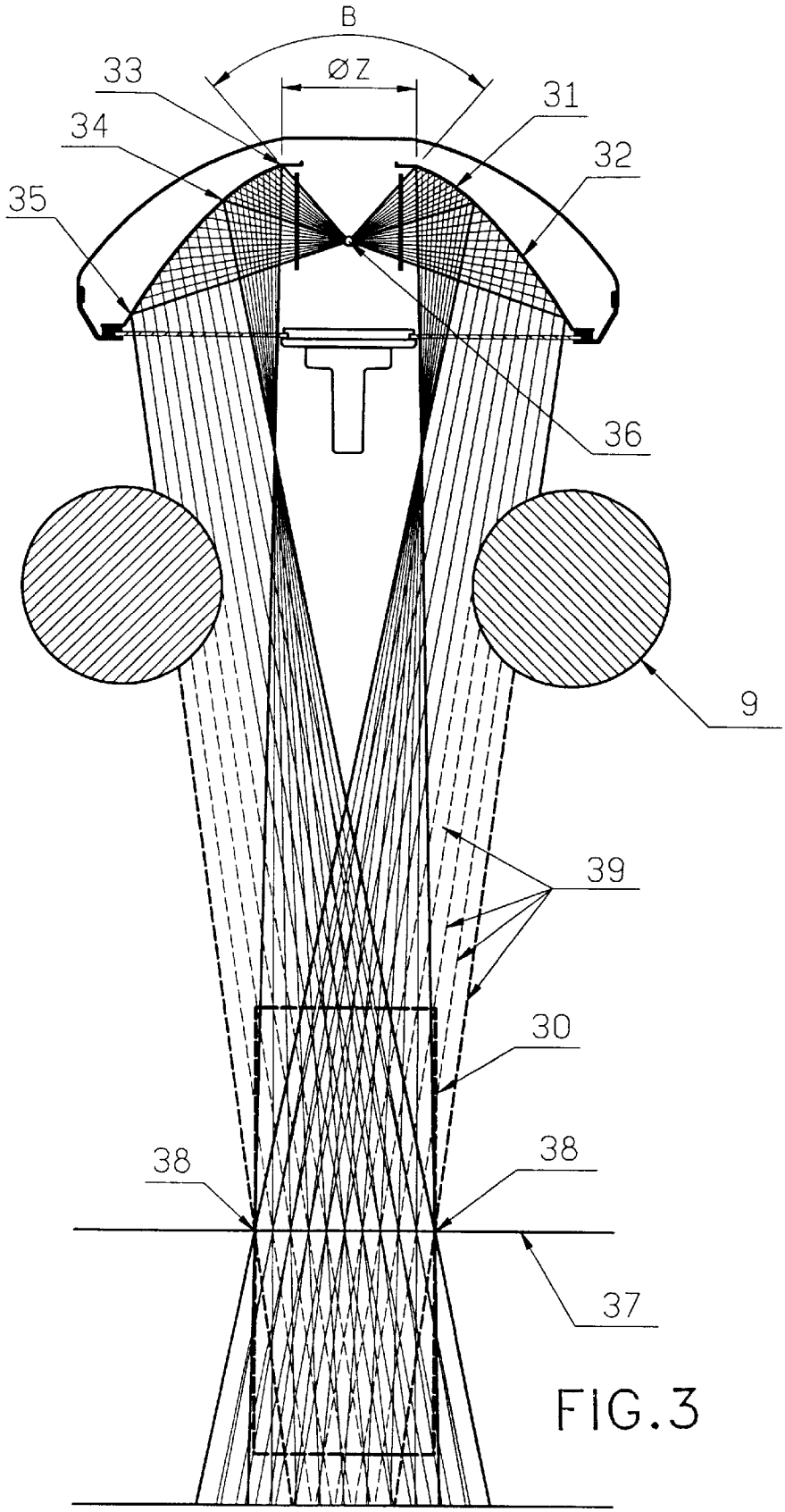
FIG. 3 shows a light reflection path of the first and the second datum curves of the present invention.
Figure 5:
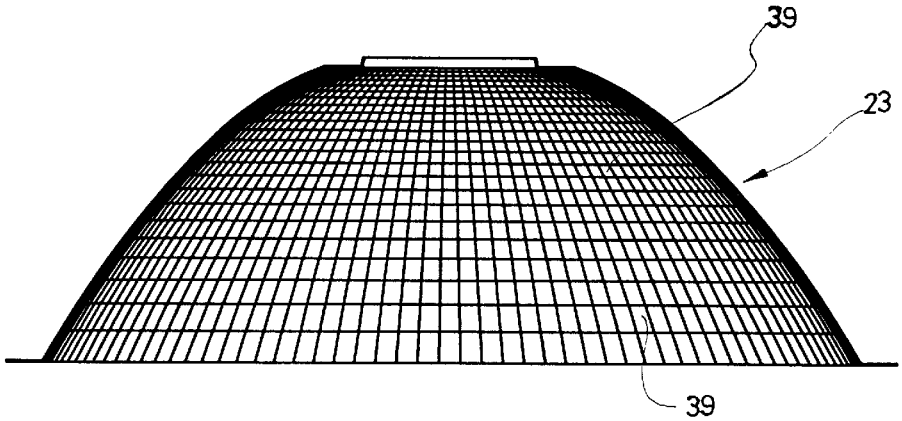
FIG. 5 is a sectional view along the line A—A' in FIG. 4.

As the above illustrates, the features of the present invention are based on the two or more datum curves. The surface including the curves is symmetrical with respect to the reflection diameter centerline and the curves turn by 360° about the center line of the reflector 23 to form the profile of the inner surface of the reflector. As shown in FIG. 3, the first datum curve 31 is closer to the centerline of the reflector than the second datum curve 32. The second datum curve 32 is close to the outer edge of the reflector, and the two datum curves have an equal tangent slope at the connecting point 34. The light rays from the filament center 36 are successively and evenly reflected by each datum curve to the area between two end points 38 of the circular diameter centered by the reflector centerline on a focusing datum plane 37. The light rays are reflected by the starting point 33 of the first datum curve 31 to the same endpoint as the rays reflected by the end 35 of the opposite side of the second datum curve 32, i.e., to one side of the illumination range. The light rays are also reflected by the connecting point 34 of the two datum curves to the opposite side of the illumination range.

Figure 1:
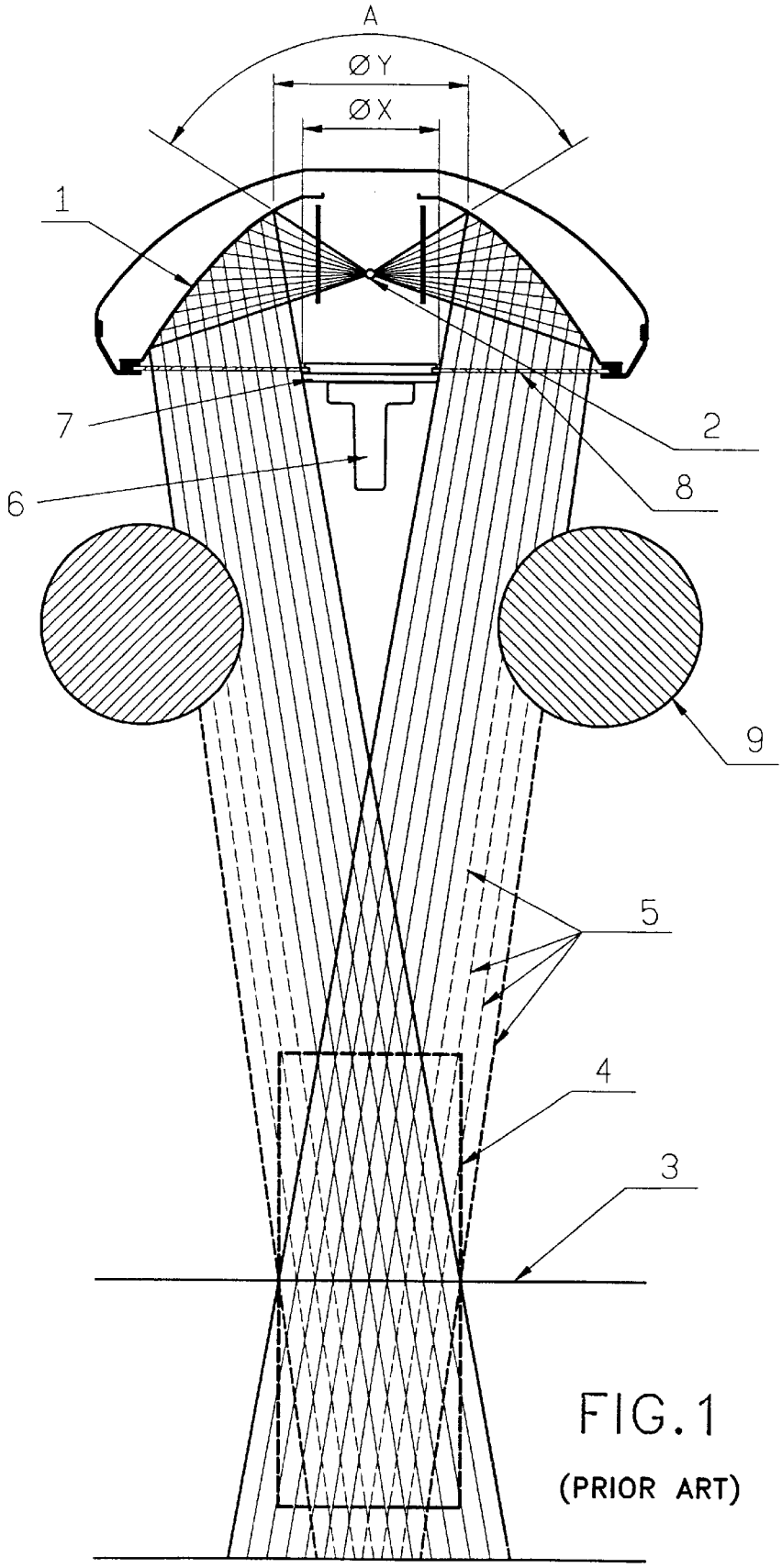
FIG. 1 (PRIOR ART)
FIG. 1 shows the basic structure and the light path of the conventional light fixture with single large reflector.

The light rays that reflect from the first datum curve 31 to the illuminating range 30 are away from the head position of the surgeon in operation 9 so that the head shadow can be effectively decreased. Evidently, the lost diameter of the reflector $\phi$ Z in accordance with the present invention can be smaller than the diameter of the disk-shaped portion $\phi$ X shown in FIG. 1. In another words, the lost diameter can be smaller than the conventional one. From the above deduction, the lost angle of light source B of the present invention is apparently smaller than the conventional lost angle of light source A. The light rays produced by the bulb can be effectively utilized and the illumination in the illuminating range 30 is enhanced. It is also found that light rays reflected by the first datum curve 31 and the second datum curve 32 evenly shine with different angles on the same area of the focusing datum plane 37 so that the shadowless effect is also promoted.

Figure 4:
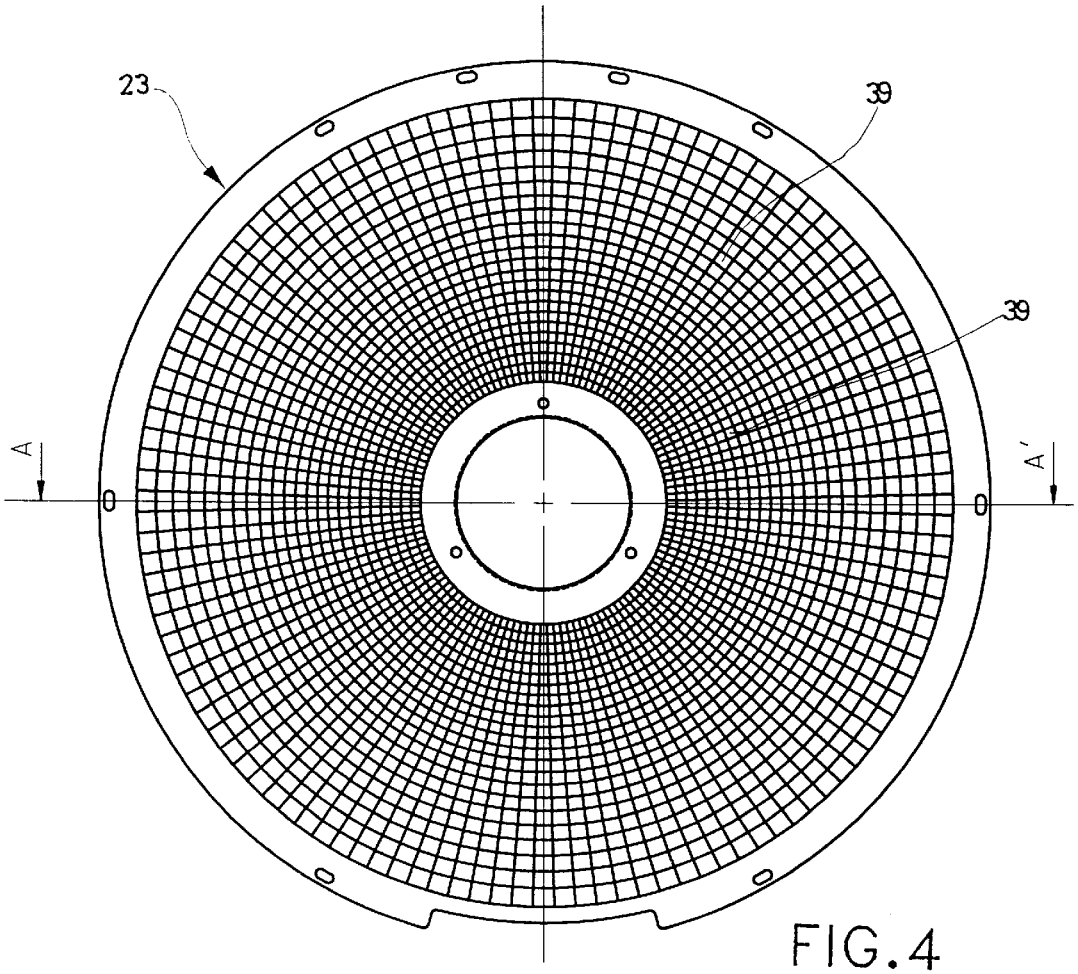
FIG. 4 is a bottom upward view of the present invention.

The reflector 23 of another preferred embodiment makes use of the two datum curves to form several small planes 39 which are tangent to the datum curves and have edges whose tangents intersect at the centerline. These small planes 39 are situated around the centerline of the reflector 23 as shown in FIG. 4. A partial light scattering effect will be produced in the illuminating range to weaken the shadow of the hand and medical instruments and a softening function of the conventional wave type front glass 8 is also included. Therefore, the wave type front glass 21 can be replaced with the plane type one having a penetrating rate for visible light of over 95% to considerably enhance the illumination in the illuminating range 30.

Figure 6:
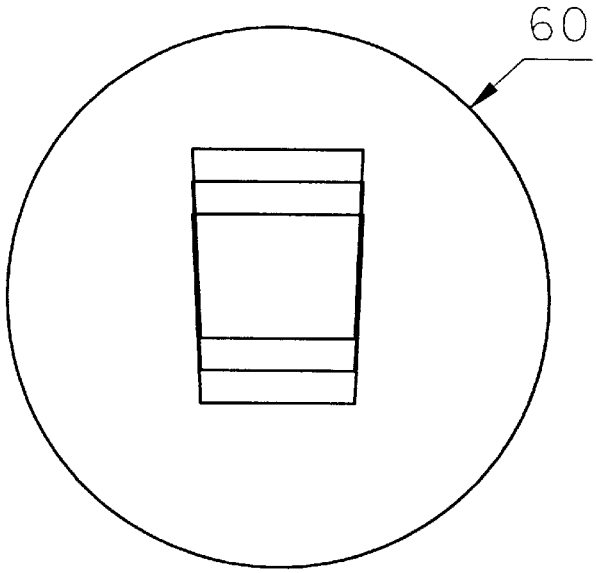
FIG. 6 shows the reflection light rays of three continuous small planes to the focusing datum plane of several small planes based on the two datum curves of the present invention.

FIGS. 6 through 9, illustrate the application principle of the multi-plane reflector. FIG. 6 shows, in accordance with the present invention, the reflection light rays of three continuous small planes to the focusing datum plane 37 of several small planes 39 based on the two datum curves. The illuminating area of the small plane of different angles along the diameter direction forms a circular plane 60. The area is intersected by the reflection light rays of three continuous small planes to the focusing datum plane 37 and the cylinder of the illuminating range 30.

Figure 7:
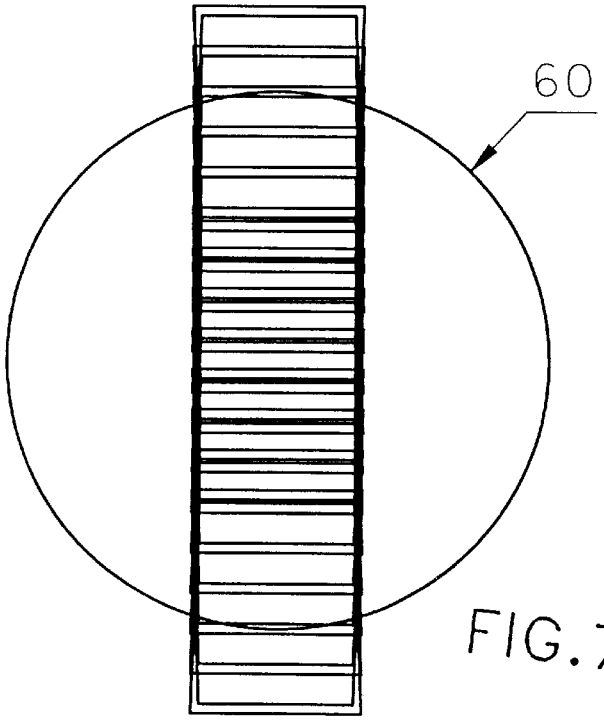
FIG. 7 shows the reflection light rays of one-row small plane to the focusing datum plane 37 built along the two datum curve of the present invention.

FIG. 7 shows, in accordance with the present invention, the reflection light rays of one-row small plane to the focusing datum plane 37 built along the two datum curves.

Figure 8:
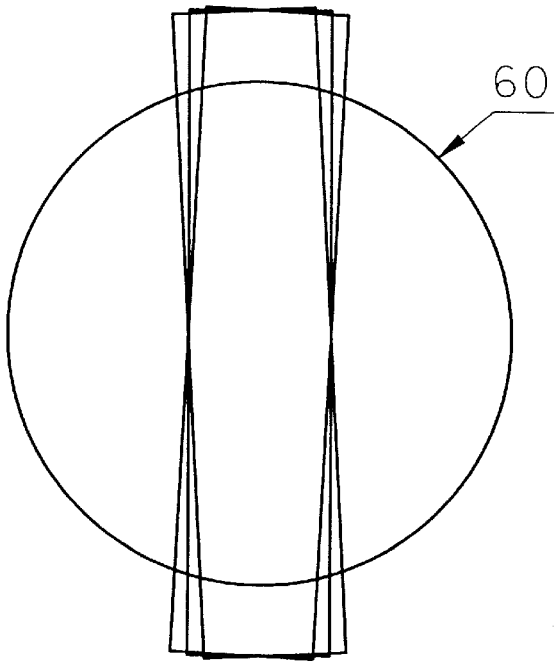
FIG. 8 shows the reflection light rays of three successive rows of small plane to the focusing datum plane 37 built along the two datum curves of the present invention.

FIG. 8 shows, in accordance with the present invention, the reflection light rays of three successive rows of small planes to the focusing datum plane 37 built along the two datum curves. The illuminating area of the small planes of different angles along the diameter direction forms a circular plane 60. The area is intersected by the reflection light rays of three successive rows of continuous small planes to the focusing datum plane 37 and the cylinder of the illuminating range 30.

Figure 9:
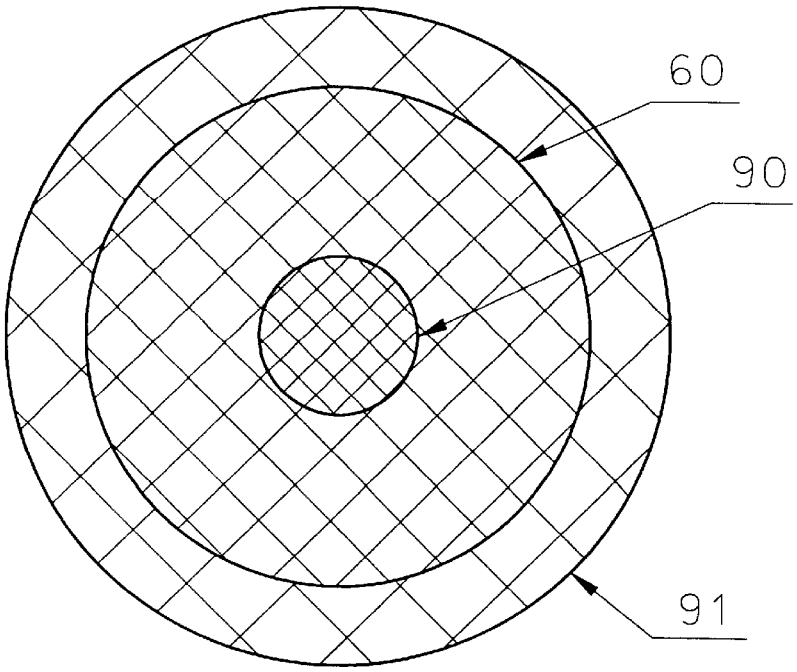
FIG. 9 shows the reflection light rays for a full circumference of small planes to the focusing datum plane 37 built along the two datum curves of the present invention.

FIG. 9 shows, in accordance with the present invention, the reflection light rays for a full circumference of small planes to the focusing datum plane 37 built along the two datum curves. A bright and even illuminating range is formed on the circular plane 60 in the middle of which there is a lighter circular area 90, and outside which there is a lighter circular halo 91.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

I claim:

1. A profile of a shadowless reflector, comprising a shade in which an inverted bowl-shaped reflector is mounted; a plain front glass fitted in an opening of the bowl-shaped reflector; a handle having a disk-shaped portion attached to a middle of the plain front glass; a socket installed over the middle of the plain front glass; a bulb placed in said socket opposite said handle; and a cylindrical heat absorbing glass fitted around said bulb, wherein a profile of a reflecting surface of said reflector is defined by at least two coplanar datum curves, each having first and second ends, the first ends of the two datum curves being connected at a connection point, wherein rotation of said at least two datum curves about a centerline of said reflector defines the profile of the reflecting surface of said reflector, wherein one of said datum curves closer to the centerline of the reflector than the other is a first datum curve, wherein the datum curve furthest from the centerline is a second datum curve arranged to cause light rays to evenly illuminate an area of a datum plane, and wherein the first datum curve closer to the centerline is arranged to cause light rays to diverge at the datum plane and illuminate the same area of the datum plane illuminated by light rays reflected by the second datum curve such that light rays reflected by the second end of the first datum curve intersect light rays reflected by the second end of the second datum curve at a same location on an edge of said same area of the datum plane, and such that light rays reflected by the connection point illuminate an opposite edge of said same area of the datum plane.

2. A profile of a shadowless reflector as claimed in claim 1, wherein slopes of said first ends of said at least two datum curves at said first ends of the datum curves are equal.

3. A profile of a shadowless reflector as claimed in claim 1, wherein said reflector is equiangularly divided into a plurality of small planes, wherein respective said small planes intersected by said at least two datum curves simultaneously reflect light onto a same portion of area of the datum plane.

* * * * *